US005133621A

United States Patent [19]

Gonzales

[11] Patent Number: 5,133,621

[45] Date of Patent: Jul. 28, 1992

[54] ARTICLE AND PROCESS FOR CREATING DESIGNS ON THE SURFACE OF CONCRETE

[76] Inventor: Edward S. Gonzales, D-71983 FA 2116 P.O. Box 29, Represa, Calif. 95671

[21] Appl. No.: 691,524

[22] Filed: Apr. 25, 1991

[51] Int. Cl.[5] ..... B05D 1/32

[52] U.S. Cl. ..... 404/72; 404/93; 427/272

[58] Field of Search ..... 404/72, 89, 93, 94, 404/97; 427/271, 272

[56] References Cited

U.S. PATENT DOCUMENTS 1,950,169 3/1934 Farasey ..... 404/94
4,239,820 12/1980 Salvador ..... 427/272
4,952,104 8/1990 Osada ..... 427/272 X
4,954,192 9/1990 Dziekan ..... 427/272 X

*Primary Examiner*—William P. Neuder
*Attorney, Agent, or Firm*—Donald A. Kettlestrings

[57] ABSTRACT

An article and process for creating designs on the surface of concrete are provided wherein the flat, flexible article is placed onto and worked into the smooth, wet surface layer of concrete. The concrete is permitted to harden to a partially set condition and the article is lifted from the partially set surface layer of the concrete to leave an impression of the article in the surface layer which becomes a permanent impression when the concrete hardens to a fully set condition.

16 Claims, 2 Drawing Sheets

Fig. 1.
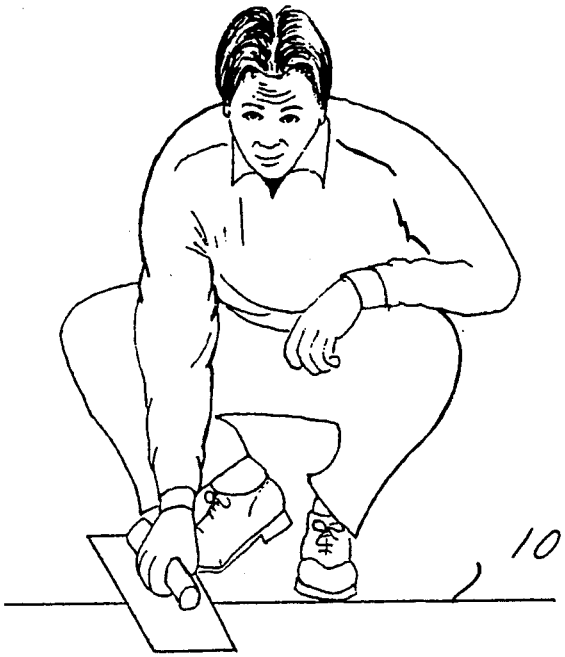
Fig. 2.
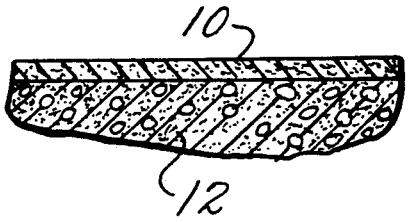
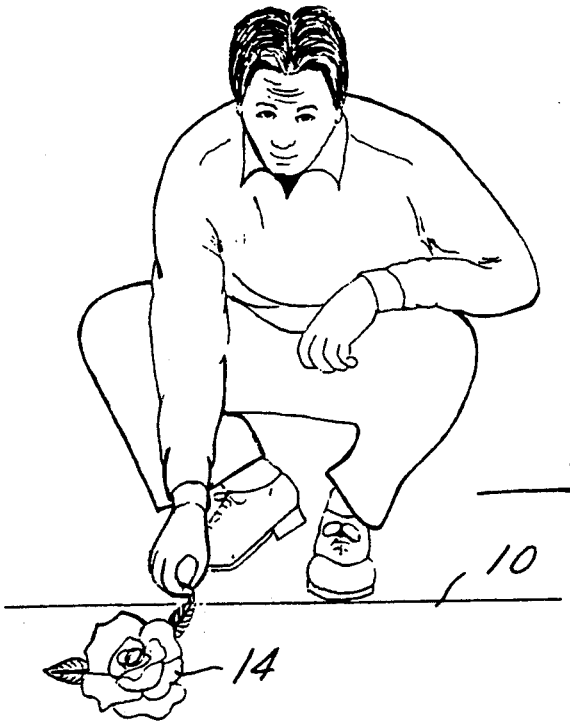
Fig. 4.
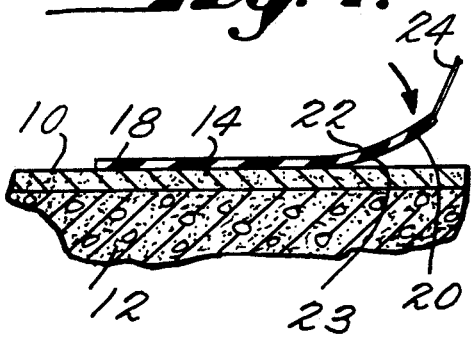
Fig. 3.

Fig. 5.
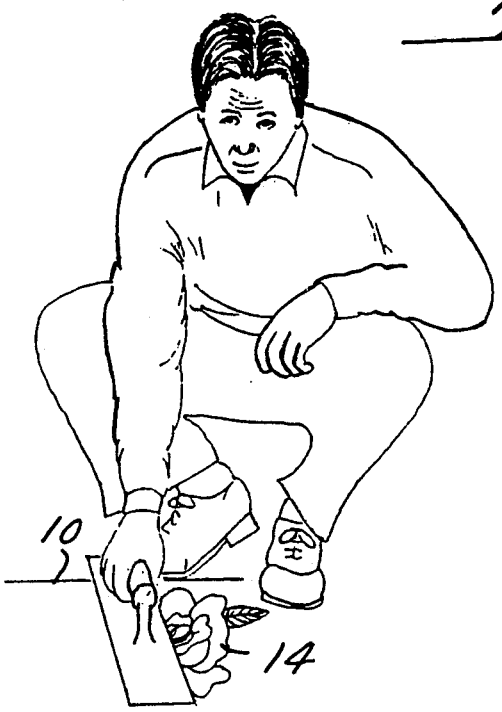
Fig. 6.
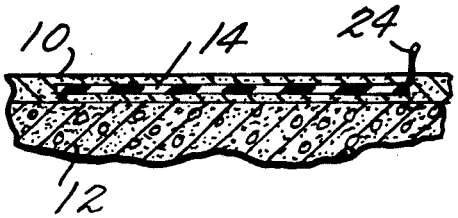
Fig. 7.
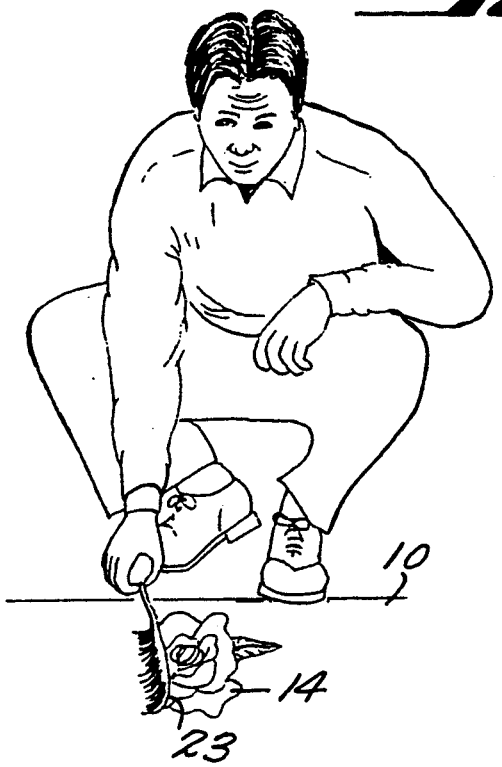
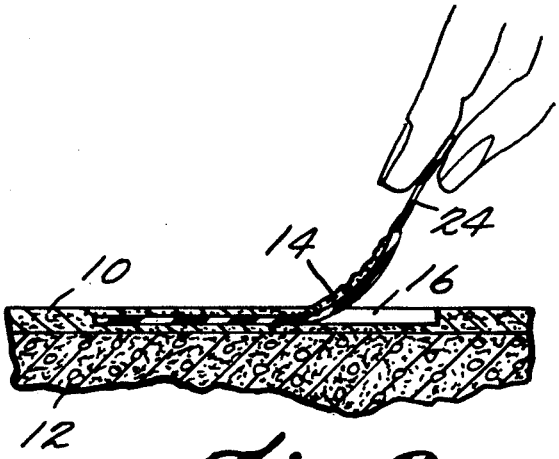
Fig. 8.

ARTICLE AND PROCESS FOR CREATING DESIGNS ON THE SURFACE OF CONCRETE

This invention relates to an improved article and process for creating designs on the surface of concrete.

Various types of concrete stamping and imprinting tools are known. Although such tools have served the purpose, they have not proved entirely satisfactory because they are expensive to manufacture and difficult to use. More specifically, the heavy stamping tools must be forcefully inserted into the concrete, and the tools must cut downwardly through the concrete to defeat and displace the gravel and other aggregate of the concrete. Because of the expense of manufacture of such tools and because of their weight and bulk, it is difficult and inconvenient to maintain and use a large number of such tools to provide a variety of patterns. Each different pattern requires the use of a separate tool.

Known stamping tools which must be forced into concrete to form impressions frequently displace the concrete in an undesirable manner when the tool is retrieved from the concrete. When the heavy tool is pressed into the concrete, air is forced out from the space between the tool and the concrete by the application of pressure. This causes a suction force between the tool and the surface of the concrete, and when the tool is retrieved or removed from the concrete some concrete is undesirably displaced by the suction.

Another problem encountered by use of such concrete stamping tools is the difficulty in creating a broom finish to the surface of the concrete after the tool has been used to form impressions. To broom finish an area of concrete, moisture is typically applied to broom bristles and the bristles are lightly dragged over the area of the concrete. This process typically causes concrete to be pushed or dragged into the impressions previously created by the stamping tool.

It is, therefore, an object of the present invention to provide an article and process for creating designs on the surface of concrete.

Another object is to provide such an article and process which are easy to implement.

A further object of the invention is the provision of an article and process for creating designs on the surface of concrete wherein the concrete can be quickly and easily broom-finished without forcing concrete into the impression formed by the article.

Still another object is to provide an article for creating designs on the surface of concrete which is inexpensive to manufacture and which is easy to use.

A still further object is to provide an article for creating designs on the surface of concrete which can be mass produced to form a large number of designs.

Another object is to provide an article for creating designs on the surface of concrete which is small and compact and easy to store and transport.

Still another object is to provide a process for creating designs on the surface of concrete which process can be practiced without the need for excessive strength.

Still another object is to provide an article and process for creating designs on the surface of concrete which can be used and applied by unskilled laborers.

Still another object is to provide an article for creating designs on the surface of concrete which is so inexpensive to manufacture that it can be dispose-d of after use.

Yet another object of the present invention is the provision of such an article which can be quickly and easily cleaned after use.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a process for creating designs on the surface of concrete comprising the steps of: providing a substantially flat, flexible article of predetermined depth and having a predetermined shape; finishing the concrete to form a substantially smooth, wet surface layer; placing the article onto the wet layer; working the article into the wet surface layer; permitting the concrete to harden to a partially set condition; lifting the article from the partially set surface layer to leave an impression of the article in the partially set surface layer; and permitting the concrete to harden further to a fully set condition.

The invention further provides an article for creating designs on the surface of concrete, the article comprising: a substantially flat, flexible element of predetermined depth and having a predetermined shape; the element defining first and second opposed sides, and at least the first side defining a three-dimensional design thereon for enabling the design to be impressed into a smooth, wet surface layer of the concrete.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

FIG. 1 shows a workman finishing concrete to form a smooth, wet surface layer;

FIG. 2 is a cross-sectional view of a concrete slab showing the upper wet surface layer and the lower aggregate layer;

FIG. 3 shows a workman placing an article of this invention onto the wet surface layer;

FIG. 4 is a cross-sectional view showing the article being placed onto the wet surface layer;

FIG. 5 shows a workmen working the article into the wet surface layer with a trowel;

FIG. 6 is a cross-sectional view showing the article after it has been worked into the wet surface layer;

FIG. 7 shows a workmen lifting the article from the partially set surface layer to leave an impression of the article in the partially set surface layer; and FIG. 8 is a cross-sectional view showing the article being lifted from the partially set surface layer to leave an impression of the article in the partially set surface layer.

With reference now to the drawings, wherein like reference characters designate like or corresponding parts throughout the several views, there is shown in FIG. 1 a workman finishing concrete with a trowel to form a conventional substantially smooth, wet surface layer 10. Gravel and other aggregate 12 is located beneath surface layer 10, as shown in FIG. 2.

In accordance with the invention, a substantially flat, flexible article 14 of predetermined depth and having a predetermined shape is placed onto wet surface layer 10. This step is shown in FIGS. 3 and 4.

Article 14 is then worked into wet surface layer 10 by hand troweling surface layer 10 and by smoothing the wet surface layer over article 14 to at least partially cover article 14 with a portion of wet surface layer 10. This step of the process is shown in FIGS. 5 and 6.

The concrete, including surface layer 10 and aggregate layer 12, is then permitted to harden to a partially set n. Article 14 is then lifted from partially set surface layer 10 to leave an impression of the article in the partially set surface layer. This step of the process is illustrated in FIGS. 7 and 8. The concrete, including surface layer 10 and aggregate layer 12, is then permitted to harden further to a fully set condition, and the impression 16 is permanently formed within the concrete.

If it is desired to broom-finish the concrete to create a slip-resistant surface, surface layer 10 can be conventionally broom-finished after article 14 has been worked into surface layer 10 and before article 14 is lifted from layer 10. As is well known, broom-finishing concrete is accomplished by applying moisture to the bristles of the broom and lightly dragging the broom bristles over the surface of the concrete. This step is not illustrated.

In accordance with the invention, article 14 is comprised a substantially flat, flexible element 18 of predetermined depth and having a predetermined shape. Element 18 defines first and second opposed sides 20, 22, and at least first side 20 defines a three-dimensional design 23 thereon for enabling the design to be impressed into smooth, wet surface layer 10 of the concrete.

Element 18 preferably includes a tab member 24 attached thereto and adjacent to upper side 22 for enabling a workman to grasp tab member 24 so that element 18 can be quickly and cleanly lifted from surface layer 10. When article 14 is worked into surface layer 10, tab member 24 projects upwardly and above the top surface of surface layer 10 to enable the workman to grasp tab member 24 when it is desired to lift article 14 from surface layer 10. Tab member 24 is preferably attached to article 14 in such a manner that the tab member tends to naturally project upwardly and at substantially right angles from upper side 22 of article 14 to permit the tab member to naturally project above the upper surface of surface layer 10. This is best illustrated in FIG. 6.

Article 14 is preferably made from a solid sheet of pressed rubber, and article 14 can be massed produced by injection molding. Several designs can be cut into one die so that a plurality of articles 14 can be produced simultaneously and different designs can be provided within each article.

The depth of each element 18 is approximately one thirty-second inch. Element 18 is flexible and easy to handle, but element 18 does not distort when used in the manner described. As a result, an accurate reproduction of the design located on side 20 of element 18 is impressed into the concrete.

Contrary to stamping tools currently in use, element 18 is merely placed onto wet surface layer 10 of the concrete. Element 18 is then quickly and easily worked into surface layer not involved in the process of this invention, and it is not necessary to defeat aggregate 12 or to otherwise form impressions within aggregate layer 12. As a result, no special strength or skill is required for implementing the process of this invention.

Because each of articles 14 is small and easy to transport and store, a large variety of different designs and articles can be providied, and a large variety of designs can be quickly and easily formed within the concrete surface. This is in marked contrast to the heavy and cumbersome concrete stamping tools heretofore known.

The use of rubber and the injection molding process also enables intricate and finely detailed designs to be formed within side 20 of element 18. Much more intricate and detailed designs can be formed in this manner than can be created in the cumbersome and heavy concrete stamping tools that are currently used for forming impressions in concrete.

When element 18 is worked into wet surface layer 10, it is not forcibly pressed into the concrete, as is the case with currently used heavy concrete stamping tools. As a result, air is not forced out from between element 18 and the concrete so that when element 18 is lifted from the concrete no suction is created and no undesirable deformation of the impression within the concrete occurs. This type of undesirable deformation of the impression is a common problem when using the heavy concrete stamping tools known in the art. The heavy stamping tools require that significant force be applied to force the tools downwardly and into the concrete. This forces air from between the tool and the concrete, and when the tool is withdrawn suction between the tool and the concrete causes undesirable deformation of the concrete and a clean impression is often not formed.

This invention provides a unique and advantageous process and article for creating designs on the surface of concrete.

The invention in its broader aspects is not limited to the specific details shown and described, and departures may be made from such details without departing from the principles of the invention and without sacrificing its chief advantages.

What is claimed is:

1. A process for creating designs on the surface of concrete comprising the steps of:

providing a substantially flat, flexible article of predetermined depth and having a predetermined shape;

finishing said concrete to form a substantially smooth, wet surface layer;

placing said article onto said wet surface layer; working said article into said wet surface layer;

permitting said concrete to harden to a partially set condition;

lifting said article from said partially set surface layer to leave an impression of said article in said partially set surface layer; and permitting said concrete to harden further to a full set condition.

2. A process as in claim 1 further including the step of smoothing said wet surface layer over said article to at least partially cover said article with a portion of said wet surface layer before permitting said concrete to harden to a partially set condition.

3. A process as in claim 2 further including the step of brooming over said article and said surface layer after said article has been covered by said portion of said surface layer to form a slip-resistant surface on said concrete.

4. A process as in claim 3 wherein said article defines a three-dimensional design thereon for enabling said three-dimensional design to be impressed into said surface layer of said concrete.

5. An article for creating designs on the surface of concrete, said article comprising:

a substantially flat, flexible element of predetermined depth and having a predetermined shape;

said element defining first and second opposed sides and at least said first side defining a three-dimensional design thereon for enabling said design to be impressed into a smooth, wet surface layer of said concrete.

6. An article as in claim 5 wherein said element is comprised of rubber.

7. An article as in claim 5 wherein said element includes a tab member attached thereto for grasping by a workman whereby said element can be quickly and cleanly lifted and removed from said surface layer of concrete.

8. An article as in claim 7 wherein the depth of said element is substantially 1/32 inch.

9. An article as in claim 8 wherein said element is comprised of injection molded rubber.

10. An article for creating designs on the surface of concrete, said article comprising:

a substantially flat, flexible element of predetermined depth and having a predetermined shape;

said element defining first and second opposed sides, said first said defining a three-dimensional design thereon for enabling said design to be impressed into a smooth, wet surface layer of said concrete, and said second side defining a continuous, unbroken surface.

11. An article as in claim 10 wherein said second side is smooth and flat.

12. An article as in claim 11 wherein said element includes a tab member attached thereto for grasping by a workman whereby said element can be quickly and cleanly lifted and removed from said surface layer of concrete.

13. An article as in claim 12 wherein said tab member projects upwardly and above said second side to enable a workman to grasp the tab member when it is desired to lift said article from said surface layer.

14. An article as in claim 13 wherein said element is comprised of rubber.

15. An article as in claim 14 wherein said element is comprised of injection molded rubber.

16. An article as in claim 10 wherein the depth of said element is substantially 1/32 inch.

* * * * *